US008663428B2

(12) United States Patent
Shieh

(10) Patent No.: US 8,663,428 B2
(45) Date of Patent: Mar. 4, 2014

(54) ROLL FOR A PAPERMAKING MACHINE

(75) Inventor: Yang Shieh, Wallingford, PA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/480,657

(22) Filed: May 25, 2012

(65) Prior Publication Data

US 2013/0312926 A1 Nov. 28, 2013

(51) Int. Cl.
*D21F 1/60* (2006.01)

(52) U.S. Cl.
USPC ..... 162/357

(58) Field of Classification Search
USPC ..... 162/357; 156/172, 425, 187, 154; 492/56, 48
See application file for complete search history.

(56) References Cited

U.S. PATENT DOCUMENTS

| | | | | |
|---|---|---|---|---|
| 3,512,475 | A | 5/1970 | Justus et al. | |
| 4,242,783 | A | 1/1981 | Watanabe et al. | |
| 4,368,568 | A | 1/1983 | Watanabe | |
| 5,091,027 | A | 2/1992 | Watanabe | |
| 5,887,517 | A | 3/1999 | Liang et al. | |
| 6,206,994 | B1 * | 3/2001 | Shieh et al. | 156/172 |
| 6,375,602 | B1 | 4/2002 | Jones | |
| 6,409,645 | B1 | 6/2002 | Paasonen et al. | |
| 6,435,244 | B1 * | 8/2002 | Shieh et al. | 156/425 |
| 6,514,369 | B1 * | 2/2003 | Shieh | 156/154 |
| 6,776,744 | B1 * | 8/2004 | Shieh | 492/56 |
| 2004/0162202 | A1 * | 8/2004 | Shieh | 492/35 |
| 2010/0132904 | A1 | 6/2010 | Ajoviita | |

OTHER PUBLICATIONS

P. Meijers, The Contact Problem of a Rigid Cylinder on an Elastic Layer, Applied Scientific Research Journal. vol. 18, Feb. 1968, pp. 353-382 (16 pages).
Narayan V. Deshpande, Calculation of Nip Width, Penetration, and Pressure for Contact Between Cylinders With Elastomeric Covering, TAPPI Journal, vol. 61, No. 10, Oct. 1978,pp. 115-118 (4 pages).
K.L. Johnson, One Hundred Years of Hertz Contact, Proc. Instn. Mech. Engrs., vol. 196, 1982, pp. 363-378 (16 pages).
J. J. A. Rodal, Soft-Nip Calendering of Paper and Paper Board, Proceedings of 1988 Finishing and Converting Conference, Sep. 1988 , pp. 77-85.

* cited by examiner

*Primary Examiner* — Mark Halpern
(74) *Attorney, Agent, or Firm* — Taylor IP, P.C.

(57) ABSTRACT

A roll for use in a papermaking machine has a circumferential surface formed of a polymeric material including a plurality of chemically reactive elastomer nano-particles and a resin. The polymeric material has a glassy transition temperature that is substantially the same as a glassy transition temperature of the resin alone.

22 Claims, 7 Drawing Sheets

Linear result over wide temperature range shows homogeneous nature

ROLL FOR A PAPERMAKING MACHINE

BACKGROUND OF THE INVENTION

1. Field of the Invention

The present invention relates to a roll or roll cover for use in a papermaking machine.

2. Description of the Related Art

Wearing, loading and impact resistance are all important properties of rolls or roll covers utilized in the modern papermaking industry. For example, advanced calendering rolls in the modern papermaking industry must be formed such that they are capable of running at higher speeds, higher loads and at higher temperatures and yet have a long life expectancy.

Hard-nip and soft-nip calendering rolls treat paper differently. For example, strength properties and uniformity, especially for newsprint, are better preserved with soft calendering rolls. While soft calendering is currently used on machine-finished coated (MFC) papers, uncoated supercalendered (SC) are supercalendered using harder rolls to obtain the desired finish. Many versions of such cover formulations have been developed individually to optimize the roll's performance for different applications. For example, different types of fillers, reinforcement fibers and chemical resin systems may be utilized.

While adding more filler or reinforcement fibers or using a high glassy transition temperature (Tg) resin system will increase cover hardness and improve abrasion resistance, it typically reduces the cover's impact strength, as well as other crucial nip mechanisms significantly. In contrast, improvement of the impact strength of the cover by use of a low Tg resin system or a decreased quantity of fillers or fibers results in a reduction in the cover's abrasion resistance and a dramatic drop in the temperature at which the cover can effectively operate. A change in the type of fillers or fibers or in the amount of such fillers or fibers used typically results in a high cost in both inventory and manufacturing.

What is needed in the art is a roll or roll cover for a papermaking machine which is formed such that one specific property, such as hardness, is modified while the remaining physical properties beneficial for optimal product performance are maintained.

SUMMARY OF THE INVENTION

The present invention provides a composite roll or roll cover for use in a papermaking machine. The composite roll has a circumferential surface formed of a composite including a plurality of chemically reactive elastomer nano-particles and a thermo-set resin. The composite has a glassy transition temperature that is substantially the same as a glassy transition temperature of the thermo-set resin alone.

The invention in another form is directed to a method of manufacturing a composite roll or roll cover for use in a papermaking machine. The method includes the step of mixing a plurality of chemically reactive elastomer nano-particles and a thermo-set resin to form a composite such that a glassy transition temperature of the composite is substantially the same as a glassy transition temperature of the thermo-set resin alone. An outer circumferential surface of the composite roll is formed from the composite of chemically reactive elastomer nano-particles and the thermo-set resin. The roll or roll cover may then be cured with heat and/or infrared light.

The invention in yet another form is directed to a composite roll or roll cover for use in a papermaking machine which has a circumferential surface formed of a composite including a plurality of chemically reactive elastomer nano-particles and pure polyurethane or pure rubber. The composite has a glassy transition temperature that is substantially the same as a glassy transition temperature of the pure polyurethane or pure rubber, respectively, alone.

An advantage of the present invention is one physical property (e.g., hardness) of the surface of the roll or roll cover may be targeted for change while other physical properties may be maintained in order to allow for optimal performance. This provides for improved surface quality and, thus, improved marking resistance, as well as increased toughness and a longer life expectancy.

Further, since the inventive roll or roll cover have a better surface quality, the marking resistance of the roll is improved and the paper produced may have a higher gloss.

A further advantage of the present invention is that if a mechanical load is applied to the, for example, modified resin, the stress resulting therefrom can be dissipated uniformly in all directions by transferring the load to the rubber domain. This is, at least in part, due to the addition of the chemically reactive elastomer nano-particles to the resin. The chemically reactive elastomer nano-particles are of such a size and character that they react only with side chain functional groups of the resin without affecting the resin's main chain mobility in a crankshaft frequency range. Thus, tears may be prevented by stretching the rubber core in a normal direction to the tear as they are chemically bonded with the resin matrix.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

According to an aspect of the present invention, a predefined amount of a chemically reactive elastomer nano-modifer is added to, for example, a thermo-set resin matrix to form a composite. The chemically reactive elastomer nano-modifer reacts only with side chain-functional groups of the resin matrix, thus modifying the secondary cross-linking configurations of the thermo-set resin matrix without affecting the thermo-set resin's main-chain mobility in the crankshaft frequency range. Accordingly, the Young's modulus of the thermo-set resin may be modified without affecting the glassy transition temperature. The composite is used according to the present invention to form an outer circumferential surface of a roll, for example a calender roll, or a roll cover for a roll for use in a papermaking machine.

Figure 1:
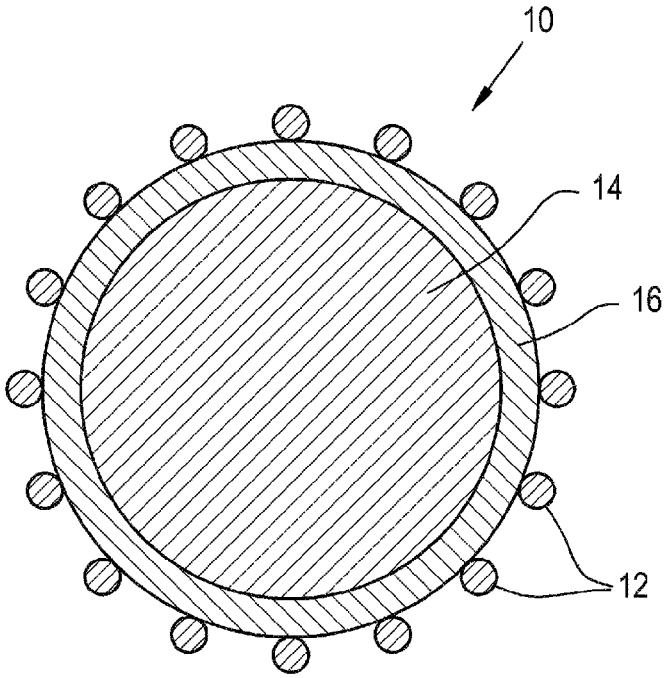
FIG. 1 is a schematic representation of a reactive nano-particle according to the present invention.

Referring now to the drawings, and more particularly to FIG. 1, there is shown a schematic representation of chemically reactive elastomer nano-particle 10, for example a silicon elastomeric nano-particle, according to the present invention. Chemically reactive nano-particle 10 has an organic shell structure including a plurality of reactive groups 12 in order to bond with, for example, a thermo-set resin or resin matrix. As is illustrated in FIG. 1, the organic shell structure of chemically reactive nano-particle 10 includes a silicone rubber core 14, which is surrounded by shell 16. Reactive groups 12 are finely distributed over an outer surface of shell 16. The chemically reactive elastomer nano-particles 10 have a substantially spherical shape and a particle size in a range of between approximately 0.05 micrometers (μm) and 5 μm, for example between approximately 0.1 μm and 3 μm.

The plurality of chemically reactive elastomer nano-particles, for example, silicone elastomer nano-particles, are between approximately 1 and 40% by weight of the polymeric material which includes the chemically reactive elastomer nano-particles and a resin, for example, a thermo-set resin, which may or may not include a plurality of reinforcement fibers. The thermo-set resin may, for example, be an epoxy resin or polyurethane.

Figure 2:
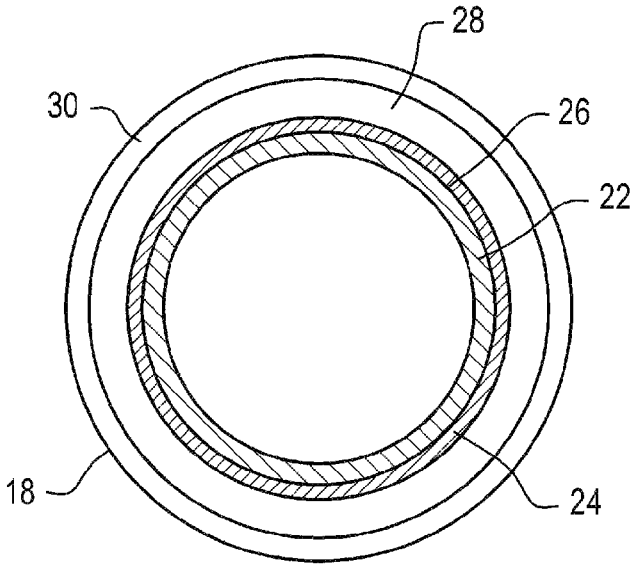
FIG. 2 is a cross-sectional view of a roll according to the present invention.

Referring now to FIG. 2, there is shown a cross-sectional view of an embodiment of a roll according to the present invention. The polymeric material may, for example, form circumferential surface 18 of roll 20, for example a calendar roll for a papermaking machine, or a coating on roll 20. According to the embodiment shown in FIG. 2, roll 20 includes roll shell 22, which may, for example, be a metal roll shell. Base layer 24, which is for example a bonding layer, is positioned to directly abut outer circumferential surface 26 of roll shell 22. At least one intermediate layer may optionally be included between base layer 24 and top layer 30. Top layer 30 is, for example, a functional layer which, based on its configuration and composition may be specifically adapted for a desired finish. The polymeric material including the plurality of chemically reactive elastomer nano-particles and resin may be incorporated into and be an integral part of roll shell 22 or may be incorporated into roll 20 in the form of a layer such as top layer 30.

In accordance with one embodiment of the present invention, the radially outermost layer or top layer 30 of roll 20 for contacting at least one of a fibrous web and a paper machine clothing has a Shore D hardness of between approximately 82 and 94. According to another embodiment of the present invention, the radially outermost layer or top layer 30 of roll 20 for contacting at least one of a fibrous web and a paper machine clothing has a hardness between approximately 0 and 65 Pusey & Jones (P & J).

The polymeric material which forms the circumferential surface of roll 20 or roll shell 22 according the present invention has a glass-liquid transition or glassy transition temperature (Tg) which is substantially the same as the glassy transition temperature of the thermo-set resin alone. For purposes of the present application, the glassy transition is the reversible transition in amorphous materials (or in amorphous regions within semi-crystalline materials) from a hard and relatively brittle state into a rubber-like state. The glassy transition temperature is thus the temperature or temperature range at which this transition takes place.

According to the present invention, the resin at a molecular level has a plurality of side-chain functional groups which extend from a main-chain backbone. The main-chain backbone may, for example, be between approximately 20 to 50 carbon atoms in length. The plurality of chemically reactive elastomer nano-particles react only with the side chain functional groups to modify a secondary cross-linking configuration of the resin without affecting the mobility of the main-chain backbone in a crankshaft frequency range. The particle size of the chemically reactive elastomer nano-particles, for example between 0.03 μm and 5 μm, allows the side functional groups to react with, but not form cross-links in the main backbone skeleton. Therefore, it allows configuration change in a three dimensional cross-linkage structure to reduce, for example the Young's modulus, but there is not sufficient configuration change in the three-dimensional cross-linkage structure to affect long-range main-chain mobility, or conformation, thus maintaining substantially the same glassy transition temperature as the resin alone. The polymeric material including the plurality of chemically reactive elastomer nano-particles and resin according to the present invention may, for example, Young's modulus less than the resin alone.

According to one embodiment of the roll cover of the present invention, a modifier in the form of chemically reactive elastomer nano-particle or nano-rubber, such as the commercially known Albidur®, is added to a resin, for example a thermo-set resin such as an epoxy resin or polyurethane which may include reinforcement fibers to form a polymeric material. The polymeric material has a glassy transition temperature that is substantially the same as a glassy transition temperature of the resin alone.

According to an additional embodiment of the present invention, there is provided a roll or roll cover for use in a papermaking machine having a circumferential surface which includes a polymeric material formed of a plurality of chemically reactive elastomer nano-particles and pure polyurethane or pure rubber. The polymeric material has a glassy transition temperature that is substantially the same as a glassy transition temperature of the polyurethane or rubber, respectively, alone.

Table 1 shown below documents the composition of a calender roll for a papermaking machine having a hardness of 91 Shore D which does not include the chemically reactive elastomer nano-particles according to the present invention.

TABLE 1

| Ingredient | (phr) | Weight % (Wt. %) |
|---|---|---|
| Standard filled epoxy resin | 100 | 0.85324232 |
| Amine hardener | 17.2 | 0.14675768 |
| Totals | 117.2 | 1 |

A calender roll cover which is modified according to the present invention, however, has a hardness of 85 Shore D is shown below in Table 2.

TABLE 2

| Ingredient | (phr) | Weight % (Wt. %) |
|---|---|---|
| Standard filled epoxy resin | 92.5 | 0.79195205 |
| Nano-rubber | 7.5 | 0.06421233 |
| Amine hardener | 16.8 | 0.14383562 |
| Totals | 116.8 | 1 |

Experimentation was conducted which measured the effect of the addition of the chemically reactive elastomer nano-particles, in this case functional nano-rubber (nano-RU), of the present invention on the hardness of a number of calender roll covers. The results are shown below in Table 3.

TABLE 3

| Shore D readings | 1 | 2 | 3 | 4 | 5 | Average | Stdev | Median |
|---|---|---|---|---|---|---|---|---|
| Reference 1 | 85 | 86 | 85 | 86 | 86 | 86 | 0.55 | 86 |
| Reference 1 + 5%-nano-RU | 82 | 82 | 81 | 81 | 81 | 81 | 0.55 | 81 |
| Reference 1 + 15%-nano-RU | 78 | 78 | 78 | 78 | 78 | 78 | 0.00 | 78 |
| Reference 2 | 87 | 87 | 87 | 86 | 87 | 87 | 0.45 | 87 |
| Reference 2 + 5%-nano-RU | 84 | 85 | 85 | 85 | 85 | 85 | 0.45 | 85 |
| Reference 2 + 15%-nano-RU | 78 | 79 | 78 | 78 | 78 | 78 | 0.45 | 78 |
| Reference 3 | 88 | 88 | 89 | 87 | 88 | 88 | 0.71 | 88 |
| Reference 3 + 5% nano-RU | 84 | 83 | 84 | 83 | 84 | 84 | 0.55 | 84 |
| Reference 3 + 15%-nano-RU | 78 | 78 | 77 | 78 | 78 | 78 | 0.45 | 78 |

As is clearly shown in Table 3, in each case the Shore D hardness of the roll cover is reduced by the addition of 5 weight % of the nano-RU and still further reduced by the addition of 15 weight %-nano-RU to the resin matrix of the cover. Advantageously, this results in a reduced vibration of the roll cover.

Table 4, shown below, evidences results of testing of a roll cover which is modified according to the present invention to include the chemically reactive elastomer nano-particles in comparison to a standard, unmodified control roll cover.

TABLE 4

| Fatigue test at 30 Hz at 175 degree F. | | | |
|---|---|---|---|
| Modified amine cured filled epoxy resin | | Standard amine cured filled epoxy resin | |
| Stress (psi) Cycles | Pass (stop) Fail | Stress (psi) Cycles | Pass (stop) Fail |
| 8,000 | 2,600,000 P | 8,000 | 2,600,000 P |
| 9,000 | 16,400,000 P | 9,000 | 6,000,000 P |
| 10,000 | 17,000,000 P | 10,000 | 2,600,000 P |
| 11,000 | 452 F. | 11,000 | 478 F. |
| 12,000 | 350 F. | 12,000 | 158 F. |

It is clear from the results shown of a fatigue test at 30 Hz and 175 degrees Fahrenheit that the modified roll cover according to the present invention has an advantage in the number of cycles which were passed at a stress of at least up to 10,000 pounds per square inch (psi), thereby showing improved life expectancy at increased stress.

Figure 3:
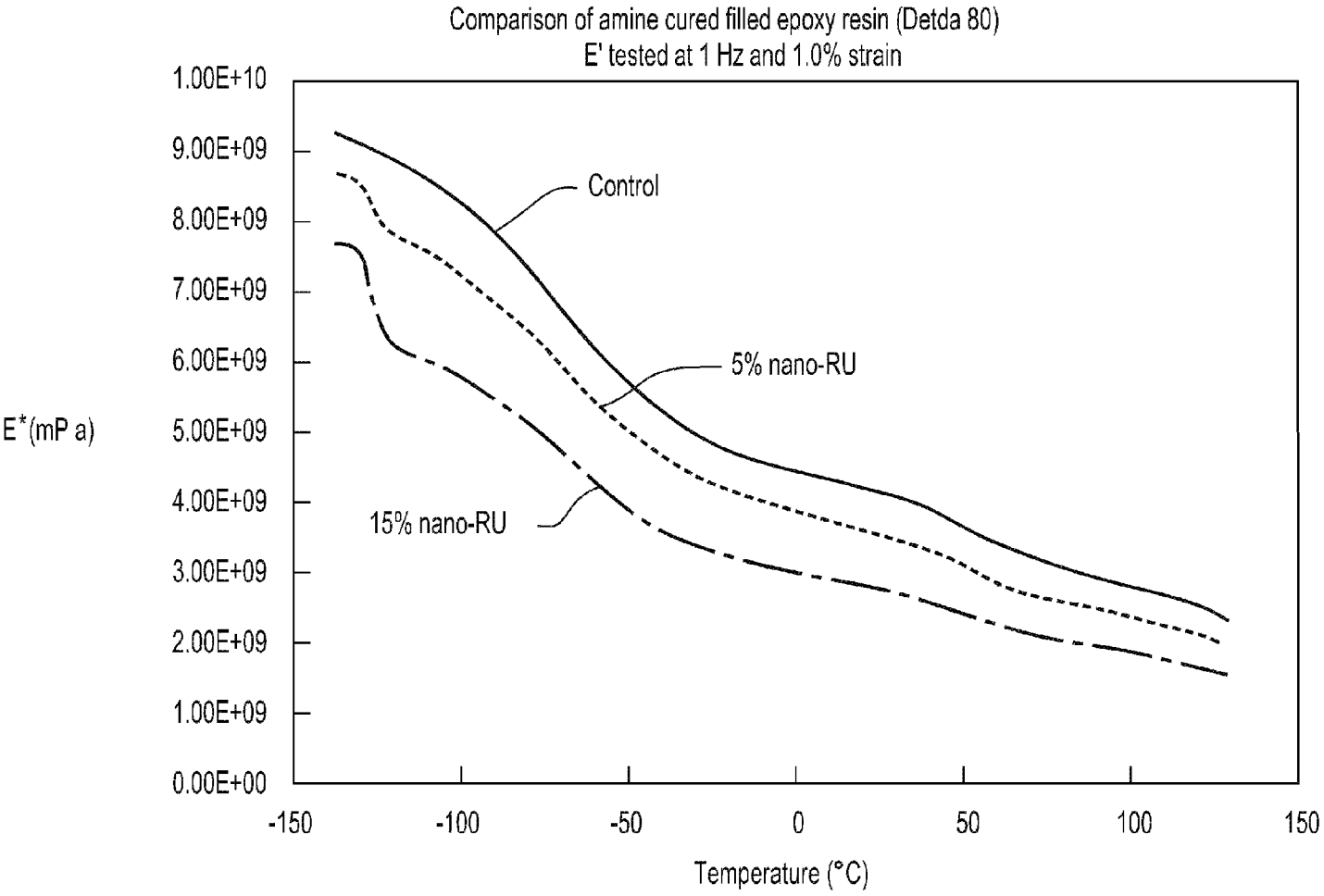
FIG. 3 shows the results of experimentation done to measure the Young's Modulus of modified roll covers manufactured according to the present invention in comparison to a control.
Figure 4:
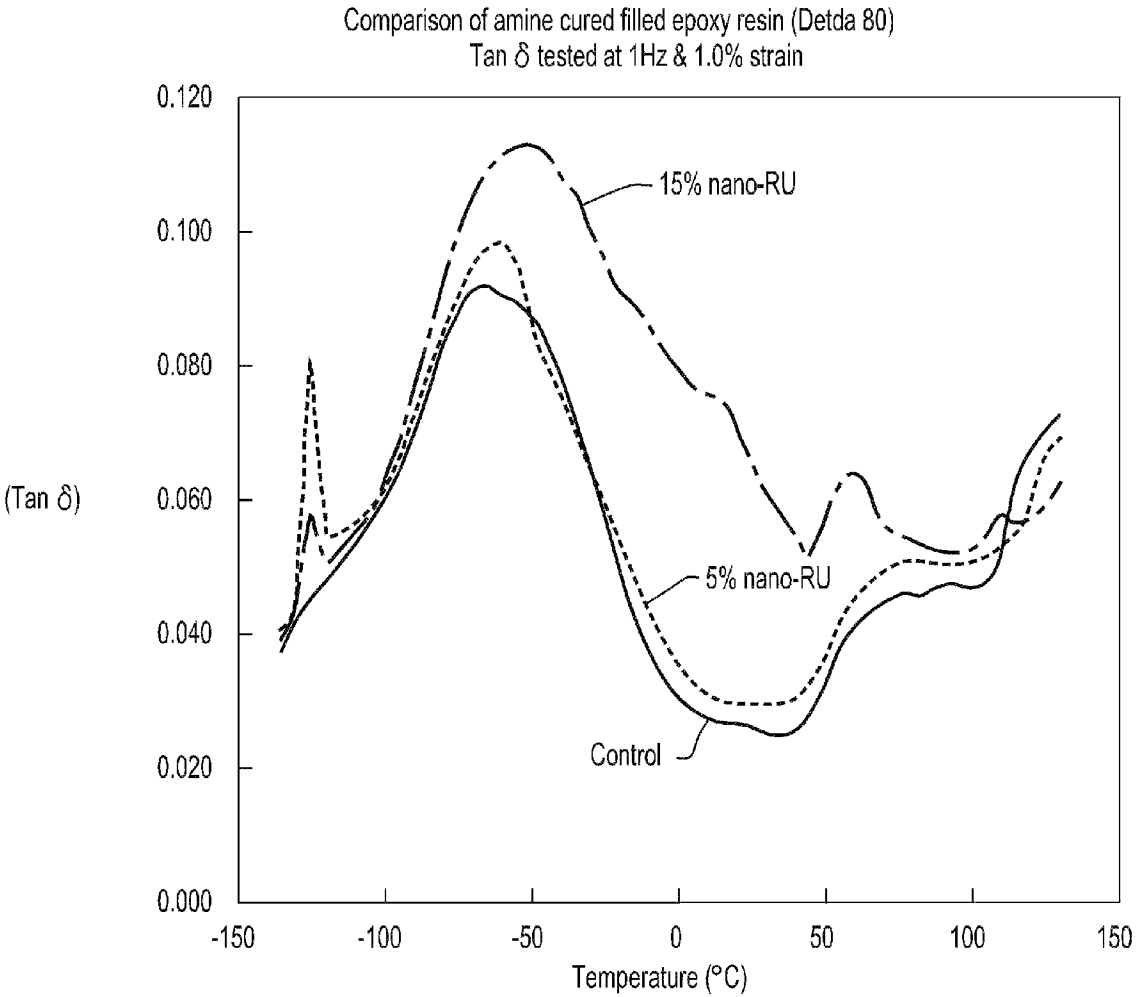
FIG. 4 shows the results of experimentation done to measure the Tan delta of modified roll covers manufactured according to the present invention in comparison to a control.

Referring now to FIGS. 2 and 3, there is shown the result of dynamic mechanical analyses on a control roll cover which does not include any of the nano-RU in comparison to roll covers including 5 weight % and 15 weight % respectively of the nano-RU with respect to temperature in degrees Celsius (° C.). Results illustrated in FIG. 3 show that the same temperature operating range is maintained with a reduced Young's Modulus (E') when tested at 1 hertz (H)z and 1.0% strain. Further, results from similar testing at 1 Hz and 1% strain, illustrated as FIG. 4 show a substantially stable low Tan delta over a wide temperature operating range.

Figure 5:
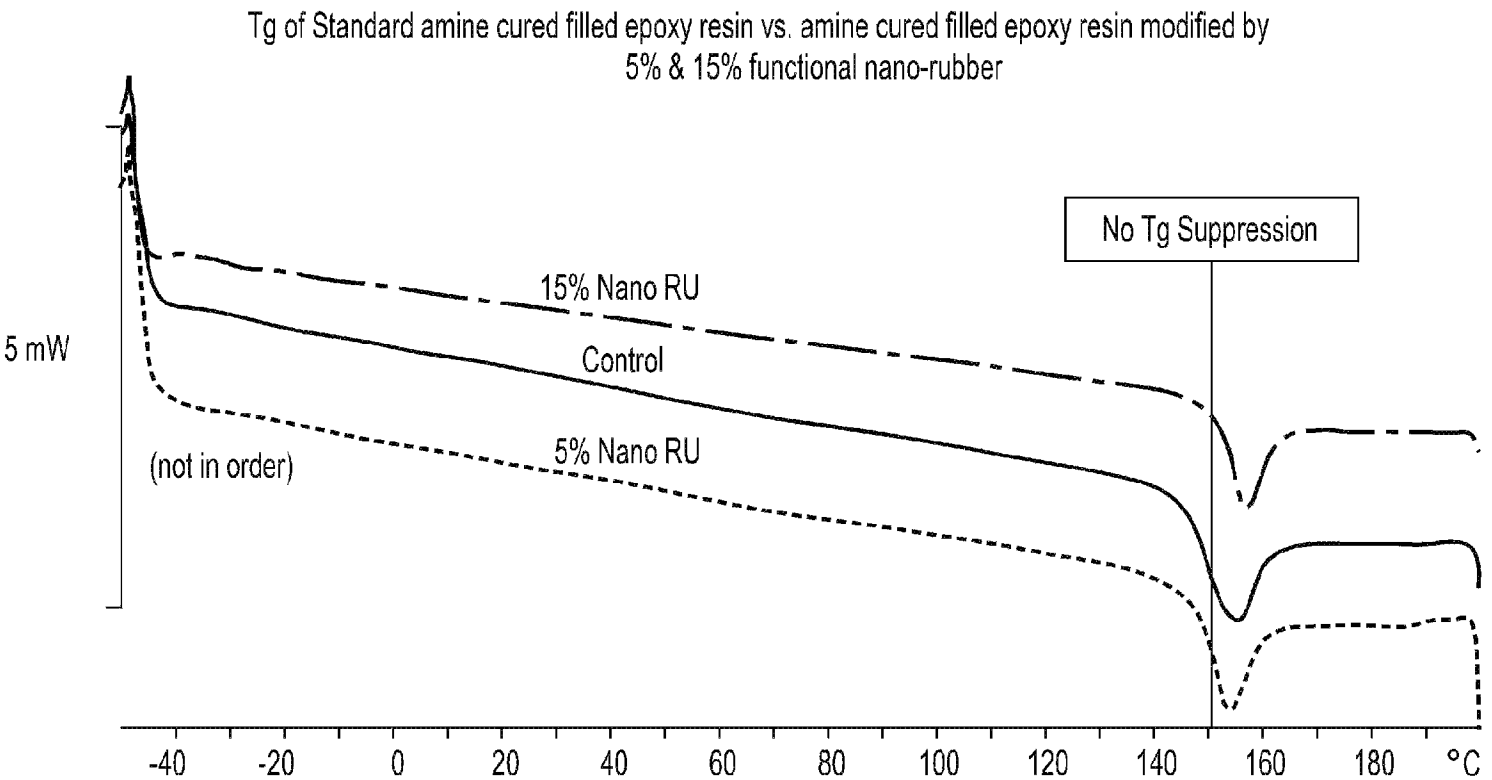
FIG. 5 shows the results of experimentation done to measure the glassy transition temperature of modified roll covers manufactured according to the present invention in comparison to a control.

A series of tests were also run on roll covers, such as those described above which included no chemically reactive elastomer nano-particle modifier, 5% by weight of the nano-RU and 15% by weight of the nano-RU, which also showed in FIG. 5 that the glassy transition temperatures of the covers including the modifier were not suppressed over the glassy transition temperature of the control roll cover.

Figure 6:
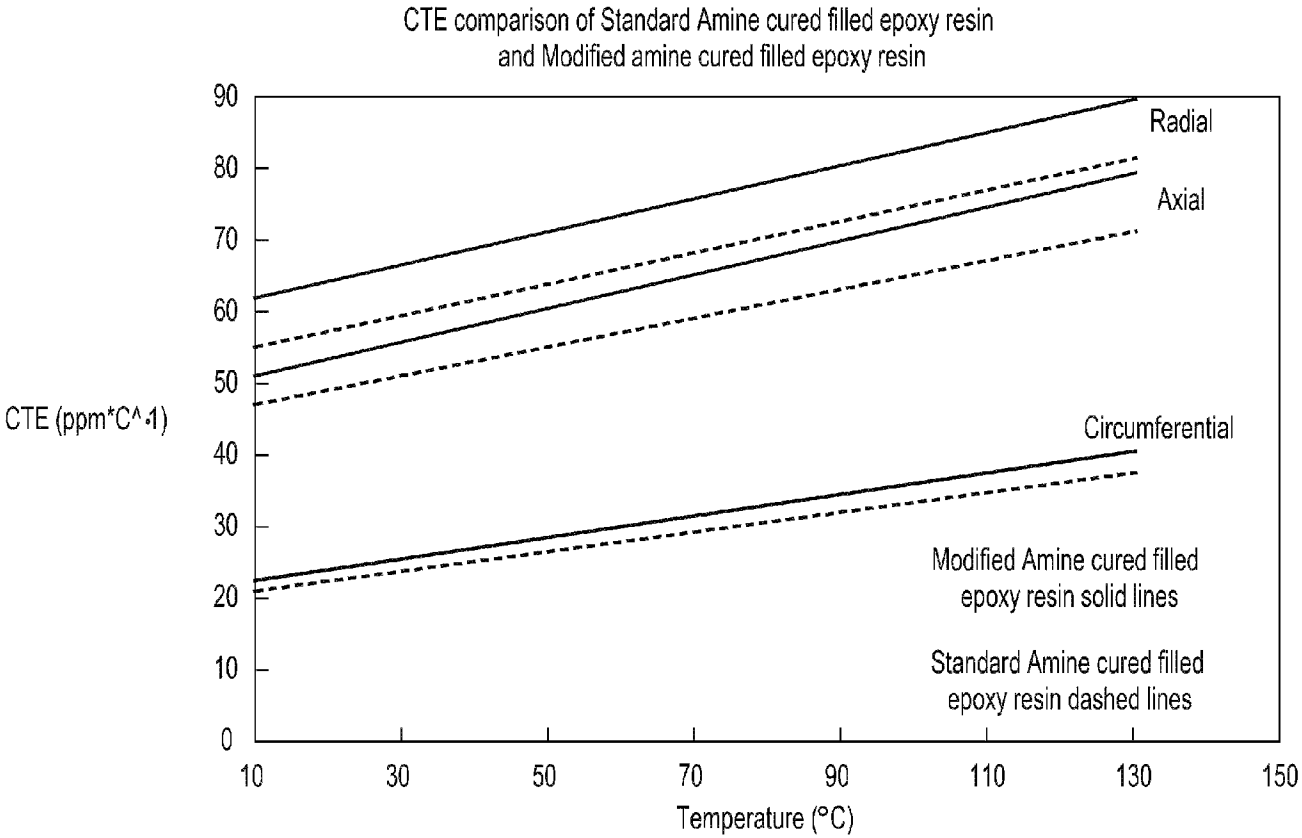
FIG. 6 shows the results of experimentation done to measure the coefficient of thermal expansion (CTE) of a modified roll cover according to the present invention in comparison to a control.
Figure 7:
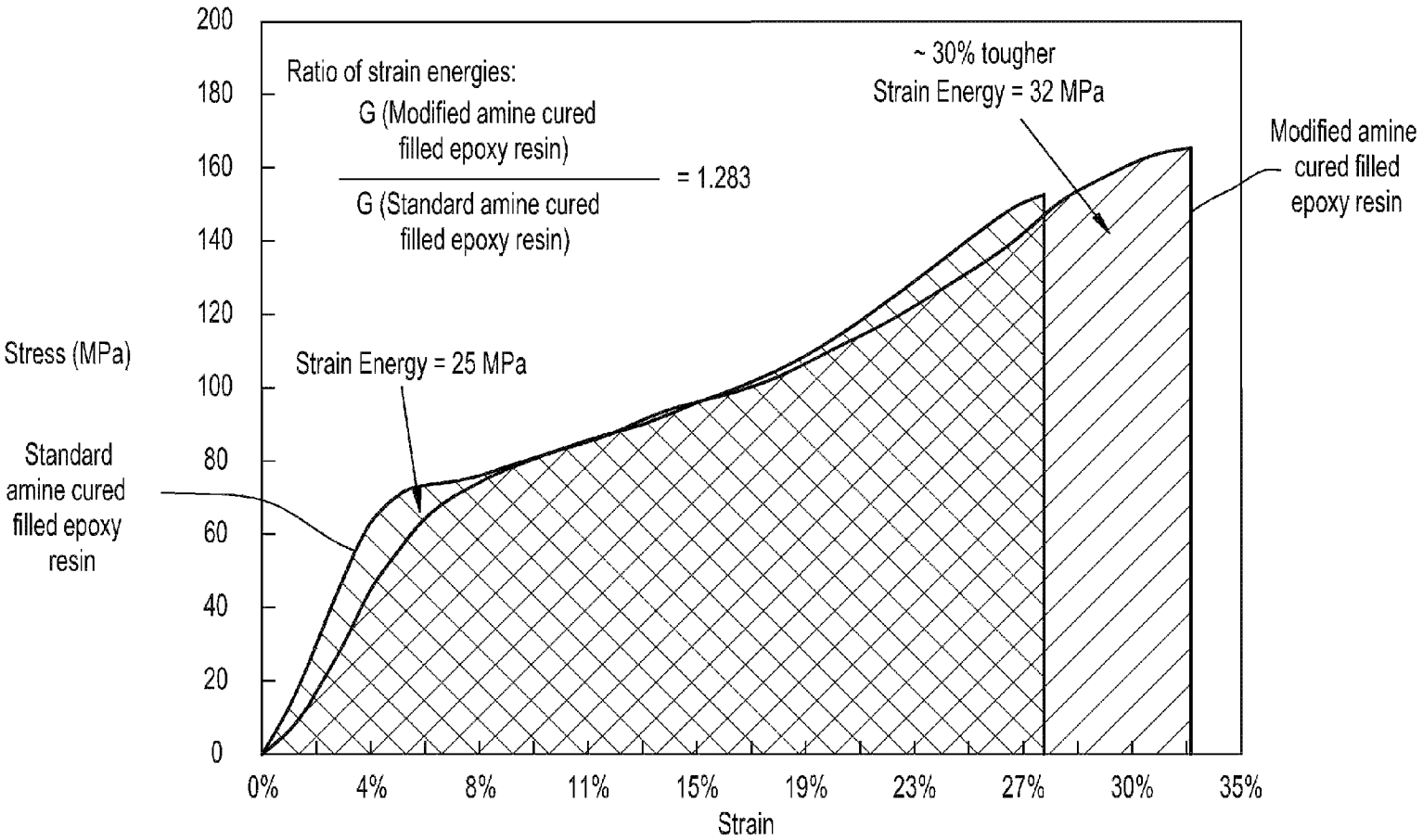
FIG. 7 shows a Stress Strain Curve of a modified roll cover according to the present invention in comparison to a control.
Figure 8:
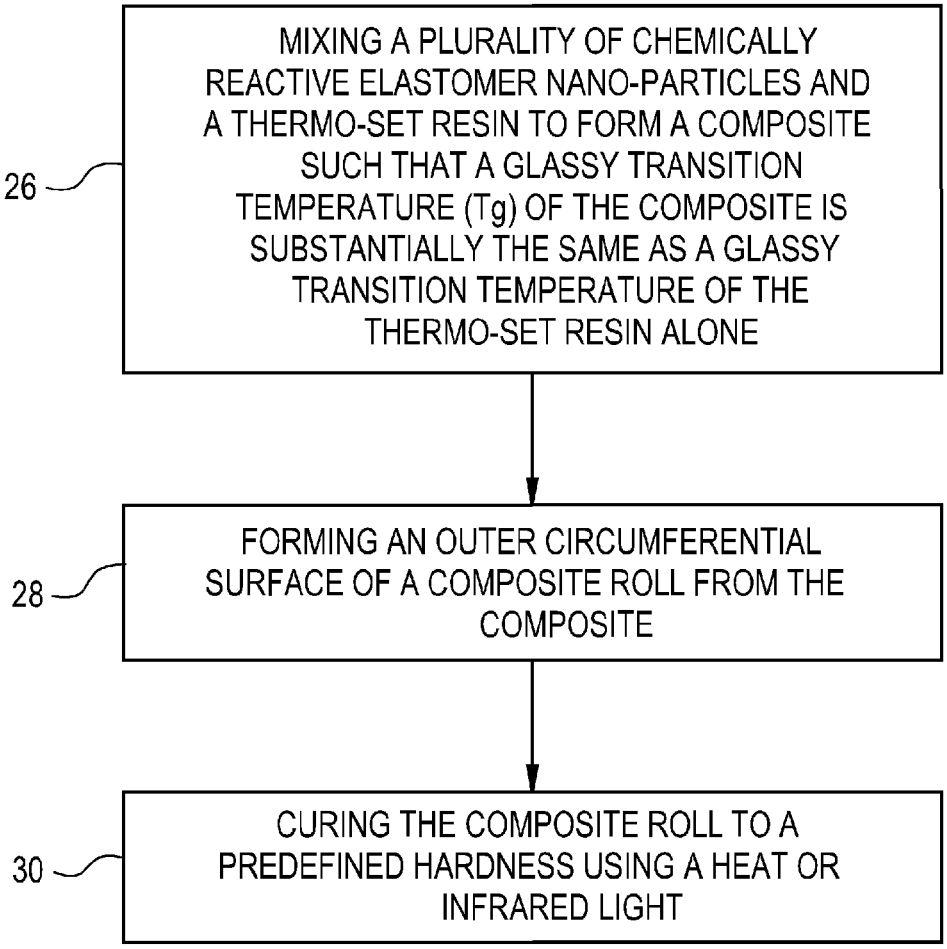
FIG. 8 is a flow chart showing a method of manufacturing a composite roll according to the present invention.

Referring now to FIG. 6, there is shown the result of testing for the coefficient of thermal expansion (CTE) over a wide temperature range of a control roll cover for a papermaking machine which does not include the chemically reactive elastomer nano-particles and a roll cover which has been modified according to the present invention to include on its outer circumferential surface the chemically reactive elastomer nano-particles. As is illustrated, there is a linear result over the wide temperature range, which shows the homogenous nature of the tested roll covers. According to the present invention, the modifier or chemically reactive elastomer nano-particles are mixed substantially homogenously through the thermoset resin, polyurethane or rubber, respectively Referring now to FIG. 7, there is shown a stress strain curve comparing a roll cover which again does not include the chemically reactive elastomer nano-particles and a roll cover which is modified according to the present invention with the chemically reactive elastomer nano-particles. It is clear from the results shown that the roll cover modified according to the present invention is approximately 30% tougher than the control or unmodified roll cover.

According to a further embodiment of the roll of the present invention, roll shell 22 includes a polymeric material and a fiber reinforcement. The polymeric material includes a plurality of chemically reactive elastomer nano-particles and a resin and has a glassy transition temperature that is substantially the same as a glassy transition temperature of the resin alone.

The present invention further provides a method for manufacturing a roll for a use in a papermaking machine. According to the method of the present invention, a plurality of chemically reactive elastomer nano-particles and a resin are mixed 32. An outer circumferential surface of the roll is formed 34 from the mixture of chemically reactive elastomer nano-particles and resin. The roll or roll cover is then cured 36, for example, heat cured or cured using infrared light, to form a composite such that the glassy transition temperature of the composite is substantially the same as the glassy transition of the resin alone.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll for use in a papermaking machine, the roll comprising:

a roll shell and a roll cover covering an outer surface of said roll shell, said roll cover including at least one circumferential layer including a polymeric material, said polymeric material including a plurality of chemically reactive elastomer nano-particles and a resin, said polymeric material having a glassy transition temperature that is substantially the same as a glassy transition temperature of said resin alone.

2. The roll according to claim 1, wherein said plurality of chemically reactive elastomer nano-particles have an elastomer core with an organic shell structure including a plurality of reactive groups.

3. The roll according to claim 2, wherein said plurality of chemically reactive elastomer nano-particles have a substantially spherical shape and a particle size in a range between approximately 0.03 and 5 micrometers (μm).

4. The roll according to claim 3, wherein said particle size is between approximately 0.1 to 3 μm.

5. The roll according to claim 1, wherein said plurality of chemically reactive elastomer nano-particles are between approximately 1 and 40% by weight of said polymeric material including said plurality of chemically reactive elastomer nano-particles and said resin.

6. The roll according to claim 1, wherein said resin includes a plurality of side-chain functional groups, said plurality of chemically reactive elastomer nano-particles reacting only with said plurality of side chain functional groups to modify a secondary cross-linking configuration of said resin without affecting a main-chain backbone mobility of said resin in a crankshaft frequency range.

7. The roll according to claim 1, wherein said polymeric material including said plurality of chemically reactive elastomer nano-particles and said resin have a Young's modulus less than said resin alone.

8. The roll according to claim 1, wherein said plurality of chemically reactive elastomer nano-particles include a plurality of silicone elastomer nano-particles.

9. The roll according to claim 1, wherein said resin is a thermo-set resin.

10. The roll according to claim 9, wherein said thermo-set resin is an epoxy resin.

11. The roll according to claim 9, wherein said polymeric material is in the form of a material matrix into which a plurality of fibers are embedded.

12. The roll according to claim 9, wherein into said matrix material includes a plurality of particulate fillers embedded in said matrix material.

13. The roll according to claim 1, wherein said resin is a polyurethane.

14. The roll according to claim 9 wherein said at least one circumferential layer is a radially outermost layer of the roll for contacting at least one of a fibrous web and a paper machine clothing, wherein said radially outermost layer has a Shore D hardness of between approximately 82 and 94.

15. The roll according to claim 13 wherein said at least one circumferential layer is a radially outermost layer of the roll for contacting at least one of a fibrous web and a paper machine clothing, wherein said radially outermost layer has a hardness of between approximately 0 and 65 Pusey & Jones (P & J).

16. The roll according to claim 1, wherein said roll shell includes a polymeric material and a fiber reinforcement, said polymeric material including a plurality of chemically reactive elastomer nano-particles and a resin, said polymeric material having a glassy transition temperature that is substantially the same as a glassy transition temperature of said resin alone.

17. The roll according to claim 1, wherein the roll is used as a calendar roll in a papermaking machine.

18. A method of manufacturing a roll for use in a papermaking machine, the method comprising the steps of:

mixing a plurality of chemically reactive elastomer nano-particles and a polymeric material to form a material matrix such that a glassy transition temperature of said material matrix is substantially the same as a glassy transition temperature of said polymeric material; and forming an outer circumferential layer of the roll from said material matrix.

19. The method according to claim 18, wherein said plurality of chemically reactive elastomer nano-particles have an elastomer core with an organic shell structure including a plurality of reactive groups.

20. The method according to claim 19, wherein said plurality of chemically reactive elastomer nano-particles have a substantially spherical shape and a particle size in a range between approximately 0.03 and 5 μm.

21. The method according to claim 20, further comprising the step of curing the roll to a Shore D surface hardness of between approximately 82 and 94.

22. The method according to claim 18, wherein said resin includes a plurality of side-chain functional groups, said plurality of chemically reactive elastomer nano-particles reacting only with said plurality of side-chain functional groups to modify a secondary cross-linking configuration of said resin without affecting a main-chain backbone mobility of said resin in a crankshaft frequency range.

* * * * *